137-13 SR
11/21/78 XR 4,126,182

United States Patent [19]
Allen et al.
[11] 4,126,182
[45] Nov. 21, 1978

[54] METHOD FOR DECREASING RESISTANCE TO FLOW OF CRUDE OIL UP FROM A WELL OR THROUGH A PIPELINE

[75] Inventors: Joseph C. Allen, Bellaire; Sze-Foo Chien, Houston, both of Tex.

[73] Assignee: Texaco Inc., New York, N.Y.

[21] Appl. No.: 881,226

[22] Filed: Feb. 27, 1978

Related U.S. Application Data

[60] Division of Ser. No. 714,946, Aug. 16, 1976, Pat. No. 4,100,967, which is a continuation-in-part of Ser. No. 535,896, Dec. 23, 1974, abandoned.

[51] Int. Cl.² ..... E21B 43/00; F17D 1/16
[52] U.S. Cl. ..... 166/314; 137/13
[58] Field of Search ..... 166/314; 137/13; 252/8.3, 8.55 R

[56] References Cited

U.S. PATENT DOCUMENTS

| | | | |
|---|---|---|---|
| 1,192,438 | 7/1916 | Looman | 137/13 |
| 2,981,683 | 4/1961 | Simpson et al. | 252/8.3 |
| 3,196,947 | 7/1965 | van Poollen | 166/314 |
| 3,380,531 | 4/1968 | McAuliffe et al. | 166/314 |
| 3,425,429 | 2/1969 | Kane | 137/13 |
| 3,455,394 | 7/1969 | Knight | 166/314 |
| 3,490,471 | 1/1970 | Carlin | 137/13 |
| 3,519,006 | 7/1970 | Simon et al. | 137/13 |
| 3,670,752 | 6/1972 | Marsden, Jr. et al. | 137/13 |
| 3,846,279 | 11/1974 | Merrill, Jr. | 137/13 X |
| 3,873,238 | 3/1975 | Elfarr | 166/314 X |

*Primary Examiner*—Stephen J. Novosad
*Attorney, Agent, or Firm*—Thomas H. Whaley; Carl G. Ries; Theron H. Nichols

[57] ABSTRACT

Methods and mechanisms are disclosed comprising means for mixing only water with crude oil at temperatures above 32° F. until the inversion point is crossed where a lower viscosity emulsion consisting of oil-in-water is formed for reducing resistance to flow of crude oil up from deep in a well to the surface, or through a pipeline. This oil-in-water emulsion consists of, by volume, 5 percent to 15 percent oil and 95 percent to 85 percent water.

6 Claims, 4 Drawing Figures

METHOD FOR DECREASING RESISTANCE TO FLOW OF CRUDE OIL UP FROM A WELL OR THROUGH A PIPELINE

This is a division of application Ser. No. 714,946, filed Aug. 16, 1976, now U.S. Pat. No. 4,100,967, issued July 18, 1978, which is a continuation-in-part of our patent application Ser. No. 535,896, filed Dec. 23, 1974 now abandoned.

BACKGROUND OF THE INVENTION

The energy requirements and attendant costs are relatively high when pumping heavy crudes. The problem is very severe when water invades the wellbore and forms an emulsion with the produced crude. In some cases, the restrictions to flow due to the viscous emulsion in the wellbore is greater than the flow capacity of the formation to the wellbore, and thus, the production rate is drastically lowered. A typical curve showing the increase in viscosity with increase in percentage of water is illustrated in FIG. 1. One method disclosed in U.S. Pat. No. 3,670,752 comprises dissolution of gas in the crude oils and tars at sub-freezing temperatures for pipeline transporting. The cost of freezing all of the crude is prohibitive. Other attempts to reduce the viscosity of the produced oil, as in U.S. Pat. Nos. 3,380,531; 3,425,429; and 3,467,195 were to add water and a base, such as sodium hydroxide in the presence of an emulsifying agent to provide an oil-in-water emulsion with various concentrations, such as of 30–50 percent water and 70–50 percent oil. Numerous surfactants are disclosed as emulsifiers as disclosed in U.S. Pat. Nos. 3,491,835 and 3,519,006. This addition of large amounts of expensive chemicals is prohibitive in cost, practicality, and safety.

OBJECTS OF THE INVENTION

Accordingly, a primary object of this invention is to provide a method for flowing crude oil from the bottom of a well at temperatures above 32° F. to the surface with reduced resistance to flow for producing more crude oil from the well with less energy than for producing unemulsified crude oil from the well respectively.

A further primary object of this invention is to provide a system for flowing crude oil from deep in a well to the surface with decreased resistance to flow for producing more crude oil from the well with less energy than for producing unemulsified crude oil from the well.

A still further object of this invention is to provide a method for transporting crude oil through a pipeline at temperatures above 32° F. with decreased resistance to flow for thus transporting more crude oil with less energy than for transporting unemulsified crude oil through the pipeline. A further object of this invention is to provide both a system for flowing crude oil from deep in a well to the surface above and a system for transporting crude oil through a pipeline with decreased resistance to flow that are easy to operate, are of simple configuration, are economical to build and assemble, and are of greater efficiency for the moving of crude oil.

Other objects and various advantages of the disclosed method and system for flowing crude oil from deep in a well and method and system for transporting crude oil through a pipeline with decreased resistance to flow will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, a few forms, mechanisms, or systems for carrying out the methods of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for carrying out the disclosed methods, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

This invention comprises a method and a system for flowing crude oil from deep in a well to the surface and a method and a system for transporting crude oil through a pipeline, both with decreased resistance to flow, the oil in both cases being above 32° F. (0° C.).

METHOD FOR FLOWING CRUDE OIL FROM A WELL WITH REDUCED ENERGY REQUIREMENTS AND INCREASED FLOW RATES

A method for reducing energy requirements and increasing production rates in the flowing of crude oil from deep in a well to the surface comprises:

(1) injecting water down into the well, (2) mixing only water with the crude oil at temperatures above 32° F. (0° C.) in the bottom of the well until an emulsion consisting of water and oil passes the inversion point where the emulsion transforms from a water-in-oil emulsion to a lower viscosity oil-in-water emulsion, and (3) flowing the oil-in-water emulsion at temperatures above 32° F. (0° C.) to the surface for producing more crude oil with less energy from a well than for producing unemulsified crude oil from the well.

More detailed methods comprise:

Modifying the first step in the basic method above by, (1) mixing the oil-in-water into an emulsion that contains by volume, about 5 percent to 9 percent oil and 95 percent to 91 percent water, respectively.

Another modified method comprises modifying the first step in the basic method above by, (1) mixing the oil-in-water into an emulsion that contains, by volume, about 5 percent oil and 95 percent water.

Further, the basic method above may be defined in more detail in the second step by, (1) flowing the emulsion by pumping the emulsion from the bottom of the well to the surface.

Figure 1:
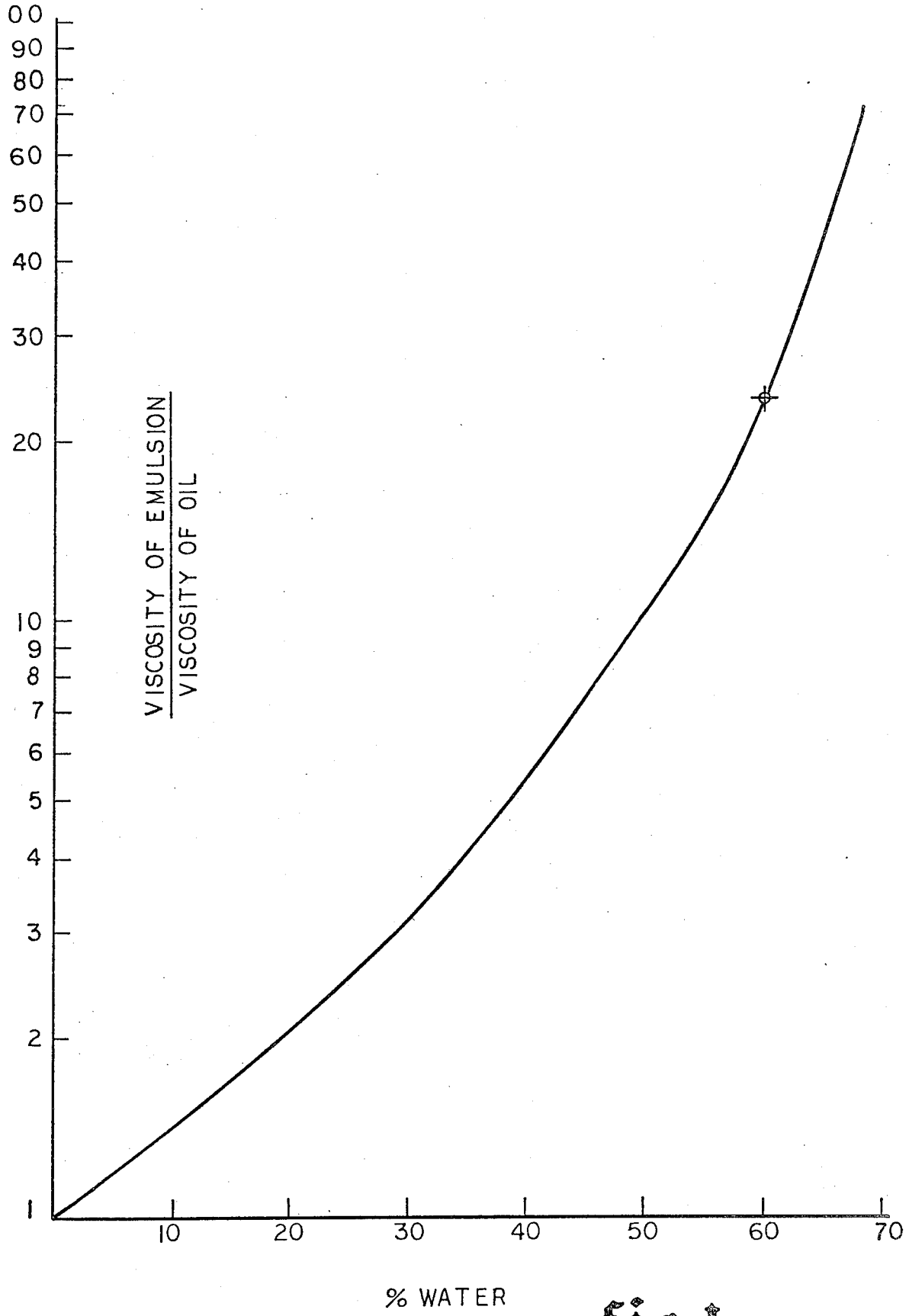
fig. 1 (PRIOR ART)
FIG. 1 is a schematic plot or curve of conventional water-in-oil emulsions of a water content of less than 70 percent.

FIG. 1 discloses a conventional plot or curve of the conventional or prior art water-in-oil emulsion with the percent of water in the emulsion as the abscissa and the viscosity of the emulsion divided by the viscosity of the oil as the ordinate in the Cartesian coordinate system. Sometimes when water invades the wellbore and forms an emulsion with the crude oil, this situation often causes quite a problem for keeping down pumping energy requirements and attendant costs as illustrated in FIG. 1 by the great increase in viscosity with added water content.

Figure 2:
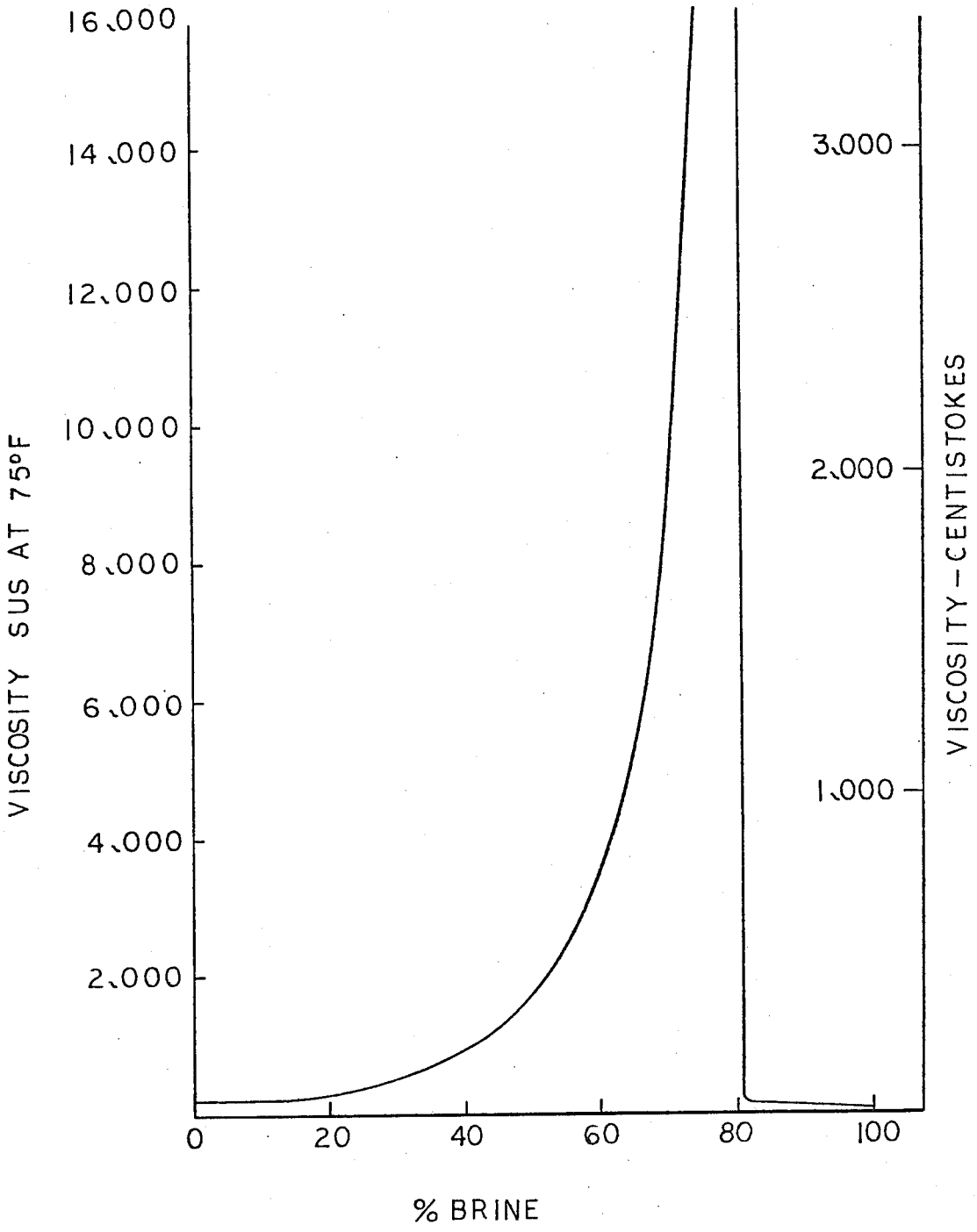
FIG. 2 is a schematic plot or curve of the disclosed oil-in-water (brine) emulsion with the viscosity of the oil plotted as the ordinate and the percentage of brine in the emulsion plotted as the abscissa.

FIG. 2 illustrates the results of plotting the viscosity in Saybolt Universal Seconds in the Saybolt Universal System (SUS) at 75° F. (about 24° C.), for example, versus the percent of salt water or brine, which brine is generally the most common and most available water.

FIG. 2 shows that inversion occurs when the water content is raised above the 80 percent zone. The inversion point is the point where the emulsion changes from water-in-oil below the inversion point to oil-in-water above the inversion point. As seen in FIG. 2, with the oil-in-water emulsion greater than 80 percent water, the resulting emulsion has a viscosity less than the viscosity of the clean oil itself, and the viscosity decreases from the inversion point with increased brine content to the viscosity of brine at the point of 100 percent brine content. With no brine present, the viscosity is that of clean oil.

Thus as the brine content increases from 0 percent, the viscosity increases gradually until the emulsion passes the area of 40 percent brine where it increases more abruptly until the brine content reaches the 80 percent area. This is the inversion of phase region wherein the brine-in-oil emulsion changes from the internal phase to the external phase. Also, this is the point where the emulsion changes from a water-in-oil emulsion to an oil-in-water emulsion. The inversion point of the water-in-oil emulsion may vary due to the particular oil viscosity, mechanism for making the emulsion, the water temperature, etc. In the disclosed invention, the inversion point occurred substantially at the 80 percent brine-to-oil ratio area on the curve.

As illustrated in FIG. 2, after inversion to the oil-in-brine type of emulsion, the viscosity will drop to a point slightly higher than the viscosity of the brine and gradually decrease until the viscosity of 100 percent brine is reached. The point at which inversion from a brine-in-oil to an oil-in-brine emulsion takes place depends on the character of oil, character of brine, and kind and degree of emulsification. In general, this point may be expected at substantially 80 percent brine content. The break in the curve of FIG. 2 between a little over 70 percent and substantially 80 percent where the curve extends off the top edge of the drawing represents a range of values of viscosity that went beyond the capability of the instruments used at the time, all values in this range being substantially greater than 16,000 seconds in the Saybolt Universal System (SUS). When emulsions near the inversion point are approached, the viscosity becomes very high, and emulsions at this point can be considered as plastic solids, especially if brine is very finely divided or a very tight emulsion. Few determinations have been made on emulsions containing more than 60 to 70 percent brine because of the difficulties experienced when working with emulsions with these high brine contents.

From the results of FIG. 2, it is evident that the emulsion having the lowest viscosity is the oil-in-brine emulsion. While the volume of fluid handled is large, it has been found, as shown in the example below, that energy requirements for pumping are reduced and production rates are increased.

SYSTEM FOR FLOWING CRUDE OIL FROM A WELL WITH REDUCED ENERGY REQUIREMENTS AND INCREASED FLOW RATES

Figure 3:
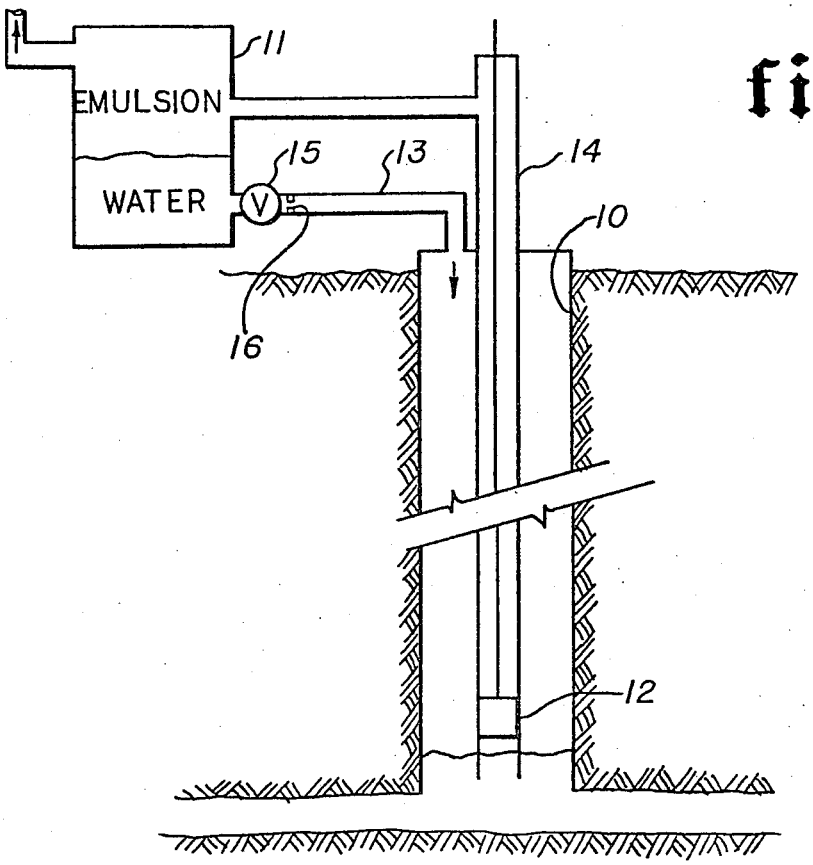
FIG. 3 is a schematic sectional view of a system for flowing crude oil from deep in a well to the surface with decreased resistance to flow.

A system is disclosed in FIG. 3 for decreasing the resistance to flow of crude oil at temperatures above 32° F. up from an oil well to the surface.

For pumping crude oil from a well casing 10, FIG. 3, with reduced energy and at increased flow rates, the disclosed system comprises a conventional water supply means, as a tank 11 for supplying water, such as brine to the well, and a conventional pump and mixer 12 deep in the well at or near the oil-water interface for mixing the desired oil-in-water emulsion at temperatures above 32° F. and for pumping it to the surface.

The tank 11, FIG. 3, having water in at least the bottom portion thereof, supplies water to a water supply pipe 13 for dumping water into the annulus of the well casing 10 formed by the upper tube portion 14 of the pump and mixer 12. A three-way valve 15 connects a supplemental water supply line to the main water supply pipe 13. An orifice 16 likewise is mounted in the main water supply line 13 downstream of the three-way valve for further control of the water to the well.

The pump and mixer 12 mixes the water with the crude oil at the level of the oil-water interface, whether the water is that water that seeps into the well or water that is supplied down the annulus, or both. Preferably the water is brine because it is usually more available. The pump and mixer 12 may be a jetting or an in-line blender for forming the oil-in-water emulsion of the precise ratio desired.

The term "bottom of the oil well" refers to the depth of the well at which the oil enters the well and forms the oil-water interface even though the well usually extends deeper.

EXAMPLE

In an examplary oil well having 3 inch (7.6 cm) tubing and $\frac{7}{8}$ inch (2.225 cm) rod, the pumping rate may be 100 BPD (barrels per day) of oil-water emulsion. The emulsion is tight and contains 40 percent oil, i.e., 40 BPD oil, and the oil has a viscosity of 800 cp (centipoise) at the producing pressure and temperature.

Two problems arise:

(1) What is the power requirement of the above emulsion?

(2) What is the power requirement to pump the same BPOD (barrels oil per day) if the above emulsion is inverted to contain 85 percent water and has a viscosity of 8 cp?

Solutions:

(1) Since 60 percent tight emulsion has a viscosity ratio of 24 (FIG. 1), the emulsion viscosity is 24 × 800 = 19,200 cp. With 60 percent emulsion having a density of 58 lb.m/ft$^3$ (lb. mass per cubic foot), the 100 BPD is equivalent to 2.92 gpm (gallons per minute or 2.45 imperial gallons per minute). The total power requirement to pump the emulsion up 1000 feet in the tubing 14 is equation (a):

$$\frac{\text{H.P.}}{1000\text{ ft.}} = \left[\frac{1}{25.4}\,\frac{Q\mu}{D^4\left[1-K^4-\frac{(1-K^2)\,2}{\ln\frac{1}{K}}\right]}+\frac{g}{gc}\,\rho\right]\frac{Q}{248}$$

Where:

$Q$ is the flow rate in gpm $\mu$ is the viscosity in cp $D$ is the tube diameter in inches $\rho$ is density in lb.m/ft$^3$ $g$ is the gravitational acceleration, 32.2 ft/sec$^2$ $gc$ is the gravitational conversion factor, 32.2 (lbm/lbf) (ft/sec$^2$)

$K$ is the ratio of (rod diameter)/(tube diameter)

The 3 inch (7.6 cm) tube has an inside diameter of 2¾ inches (6.98 cm). Thus D = 2.75 and by using a rod of 0.88 inch diameter, K = 0.312, the total power is:

$$\frac{\text{H.P.}}{1000\text{ ft.}} = \left[\frac{1}{25.4}\,\frac{2.92\times 19{,}200}{2.75^4\left[1-0.312^4-\frac{(1-0.312^2)\,2}{\ln\frac{1}{0.312}}\right]}+58\right]\frac{2.92}{248} = 2.30$$

Solution to (2):

To pump the same BOPD in an 85 percent emulsion the flow rate will be 266 BPD of emulsion. Assuming the density increased to 60.5 lb.m/ft$^3$, the total power required by the emulsion is now:

$$\frac{\text{H.P.}}{1000\text{ ft.}} = \left[\frac{1}{25.4}\,\frac{8\times 2.92\times 2.66}{2.75^4\,(0.28)}+60.5\right]\frac{2.92\times 2.66}{248} = 1.90$$

Accordingly by inverting and using the emulsion, a reduction of power requirement of (2.3−1.9)/2.3 = 17.4%.

Here it should be noted that the above is the power actually required by using the emulsion method and calculations are based upon a steady state laminar flow without any restriction in the annulus or tubing. However, in practice, there are sucker rod couplings, pump valves, etc. along the flow and the flow itself is a pulsating flow or a cyclic unsteady state flow. These additional restrictions and unsteady state of flow could add considerable favor to the case of the less viscous inverted emulsion. Furthermore, the efficiency of pumping of a more viscous emulsion is considerably less due to less efficiency in flow through pump restrictions and due to the more viscous emulsion having a tendency to foam.

It has been found that pump efficiency is low for low water content heavy oil production due to stable foams and high water content increases pump efficiency. Further from additional studies, it appears that the efficiency of a 60 percent emulsion would be 37 percent and the efficiency of the 85 percent emulsion to be 60 percent.

The horsepower requirement of the pump for the 60 percent emulsion is thus 2.3/0.37 = 6.21 (H.P./1000 ft), and for the 85 percent emulsion is 1.9/0.60 = 3.16 (H.P./1000 ft.). Comparing the power required at the pump, the 85 percent emulsion requires only 3.16/6.21 = 51 percent of the power required by that of the 60 percent emulsion. If the same power for the 60 percent emulsion is available to the new inverted emulsion, the production could be increased by 94.2 percent as shown in the following calculation:

6.21 H.P. at the pump is the equivalent to 6.21 × 60 percent = 3.72 H.P. for pumping the emulsion. The pumping rate Q can be solved from equation (a) above:

$$3.72\text{ H.P.} = \left[\frac{1}{25.4}\,\frac{Q\times 8}{2.75^4\,(0.28)}+60.5\right]\frac{Q}{248}$$

Q = 15.1 gpm (gallons per minute) or 518 BPD (barrels of 85 percent water-oil emulsion per day) or 77.7 BOPD (barrels oil per day).

Thus the increase in oil production is (77.7−40.0)/40.0 = 94.2%.

OPERATION

In operation of the system of schematic FIG. 3, the tank 11 includes a conventional device for removing all water from the emulsion so as to produce pure crude oil. Likewise additional water or brine may be added via three-way water valve 15 as required.

As water settles out in the tank or is removed from the emulsion, it gravitates into the well or casing annulus. The orifice size would be adjusted to provide the desired recirculation rate for the pressure differential due to the difference in elevations. Thus, the water flows from the tank 11 through three-way valve 15 and through the main water supply line 13 to the well 10 for passing down the annulus to the oil-water interface to enter the pump and mixer 12. Here the proper amounts of water and oil are emulsified to form the desired precise oil-in-water emulsion for being pumped up the tubing 14 to the tank 11. Thus recirculation of produced water results in accomplishing the new inversion.

While a rod actuated pump is usually the most efficient for high volume pumping of low viscous fluids, a downhole hydraulic pump may be one using oil as the power fluid and another may use water as the hydraulic fluid. An open system 12 could be used that discharges the water from the power end where it mixes with the discharge from the pump to form a combined inverted emulsion stream for increasing productivity and/or reducing lifting costs.

Accordingly, a system is disclosed for flowing crude oil from deep in a well to the surface with decreased resistance for producing more oil with less energy.

METHOD FOR FLOWING CRUDE OIL THROUGH A PIPELINE WITH REDUCED ENERGY REQUIREMENTS AND INCREASED FLOW RATES

A method for transporting crude oil at temperatures above 32° F. through a pipeline with decreased resistance to flow has been conceived. It comprises the two steps:

(1) mixing only water with the crude oil until the emulsion consisting of water and oil passes through the inversion point where the emulsion at temperatures above 32° F. changes from a water-in-oil emulsion to a lower viscosity oil-in-water emulsion, and (2) transporting the oil-in-water emulsion through the pipeline for transporting more crude oil with less energy than for transporting unemulsified crude oil through the pipeline.

The first step of the above method may be defined in more detail as:

(1) mixing the oil-in-water into an emulsion that contains, by volume, about 5 percent to 45 percent oil and 95 percent to 55 percent water.

Further the first step of the above basic method may be defined in greater detail as:

(1) mixing the oil-in-water into an emulsion that contains, by volume, about 5 percent to 15 percent oil and 95 percent to 85 percent water.

SYSTEM FOR TRANSPORTING CRUDE OIL THROUGH A PIPELINE WITH REDUCED ENERGY REQUIREMENTS AND INCREASED FLOW RATES

Figure 4:
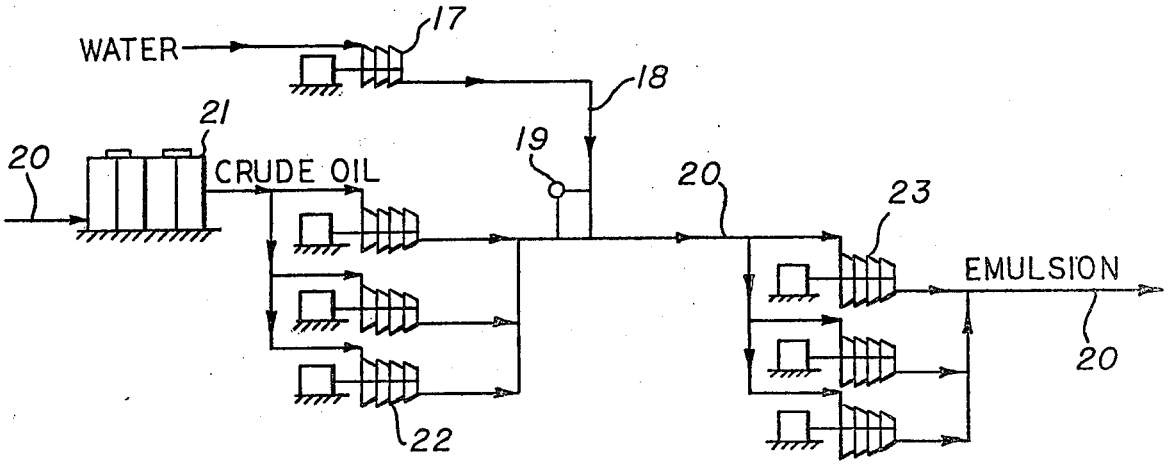
FIG. 4 is a schematic plan view of a system for transporting crude oil through a pipeline with decreased resistance to flow.

FIG. 4 illustrates a schematic system for transporting crude oil at temperatures above 32° F. through a pipeline with decreased resistance to flow. The FIGURE shows a system for mixing only water with the crude oil until an emulsion consisting of water and oil passes through the inversion point from a water-in-oil emulsion to a lower viscosity oil-in-water emulsion, and then transporting the oil-in water emulsion through the pipeline.

FIG. 4 shows a water pump 17 for supplying either brine or fresh water, whichever is preferred at the particular location, through line 18 under high pressure to a control valve 19 on main crude oil pipeline 20. Crude oil supply tank 21 is connected in the main line 20 for supplying crude oil to pumping plant 22 which maintains high pressure in the main line to the control valve 19. Control valve 19 supplies the precise predetermined ratio of oil-in-water to emulsion pumps 23. The emulsion pumps 23 thus provide the precise oil-in-water emulsion to the main crude oil pipeline 20 for transporting crude oil therethrough with decreased resistance to flow. This decreased resistance results in increased flow with less required energy.

As explained above, this oil-in-water emulsion most contain, by volume, about 5 percent to 45 percent oil and 95 percent to 55 percent water. More precisely, this oil-in-water emulsion should contain, by volume, about 5 percent to 15 percent oil and 95 percent to 85 percent water.

Accordingly, it will be seen that while other embodiments may be utilized to perform the above methods, at least the above disclosed methods and systems will operate in a manner which meets each of the objects set forth hereinbefore.

Obviously other methods may be utilized for the passing of crude oil through either well tubing or transmission lines of the embodiments of either FIG. 3 or FIG. 4 than those listed above, as by manual control, depending on the particular crude oil to be transported.

While only one method and one system for flowing crude oil from deep in a well and only one method and a system for transporting crude oil through a pipeline have been disclosed, it will be evident that various other methods and modifications are possible in the arrangement and construction of the disclosed methods and systems without departing from the scope of the invention and it is accordingly desired to comprehend within the purview of this invention such modifications as may be considered to fall within the scope of the appended claims.

We claim:

1. A method for flowing crude oil at temperatures above 32° F. from the bottom of a well to the surface with decreased resistance to flow comprising, (a) mixing only water with the crude oil at temperatures above 32° F. in the bottom of the well until an emulsion consisting of water and oil passes the inversion point where the emulsion transforms from a water-in-oil emulsion to a lower viscosity oil-in-water emulsion that contains, by volume, about 5 percent to 9 percent oil and 95 percent to 91 percent water, and (b) flowing the oil-in-water emulsion to the surface for producing more crude oil with less energy from a well than for producing unemulsified crude oil from the well utilizing expensive chemicals which are prohibitive in costs, practicality, and safety.

2. A method as recited in claim 1 wherein the first step comprises, (a) mixing the oil-in-water into an emulsion that contains, by volume, about 5 percent oil and 95 percent water.

3. A method as recited in claim 1 wherein, (a) the step of flowing the oil-in-water emulsion comprises pumping the emulsion from the bottom of the well to the surface.

4. A method for transporting crude oil at temperatures above 32° F. through a pipeline with decreased resistance to flow comprising, (a) mixing only water with the crude oil until the emulsion consisting of water and oil passes through the inversion point where the emulsion changes from a water-in-oil emulsion to a lower viscosity oil-in-water emulsion at temperatures above 32° F. that contains, by volume, about 5 percent to 9 percent oil and 95 percent to 91 percent water, and (b) transporting the oil-in-water emulsion at temperatures about 32° F. through the pipeline for transporting more crude oil more economically and with less energy than for transporting unemulsified crude oil through the pipeline utilizing expensive chemicals which are prohibitive in cost, practicality, and safety.

5. A method as recited in claim 4 wherein the first step comprises, (a) mixing the oil-in-water into an emulsion that contains, by volume, about 5 percent oil and 95 percent water.

6. A method as recited in claim 4 wherein, (a) the step of transporting the emulsion is performed by pumping the emulsion through the pipeline.

* * * * *